United States Patent [19]

Hattori et al.

[11] Patent Number: 4,627,814

[45] Date of Patent: Dec. 9, 1986

[54] CONTINUOUS TYPE ATMOSPHERE HEAT TREATING FURNACE

[75] Inventors: Fumihiko Hattori, Izumi; Yoshikazu Shimosato, Yahata, both of Japan

[73] Assignee: Chugai Ro Co., Ltd., Osaka, Japan

[21] Appl. No.: 755,939

[22] Filed: Jul. 16, 1985

[30] Foreign Application Priority Data

Jul. 17, 1984 [JP] Japan ..... 59-149130

[51] Int. Cl.[4] ..... F27B 9/02; F27B 5/04; F27B 5/14; F27D 7/04

[52] U.S. Cl. ..... 432/128; 432/72; 432/144; 432/198; 432/199; 432/209; 432/239

[58] Field of Search ..... 432/72, 128, 138, 144, 432/198, 199, 209, 239

[56] References Cited

U.S. PATENT DOCUMENTS

| | | | |
|---|---|---|---|
| 802,517 | 10/1905 | Kugel | 432/128 |
| 2,167,676 | 8/1939 | Pechy | 432/239 |
| 2,205,258 | 6/1940 | Hansen | 432/72 |
| 2,713,480 | 7/1955 | Ruckstahl | 432/128 |
| 3,850,318 | 11/1974 | Wentworth | 432/128 |
| 3,982,887 | 9/1976 | Kendziora et al. | 432/128 |
| 4,214,869 | 7/1980 | Thekdi et al. | 432/209 |

*Primary Examiner*—John J. Camby

*Attorney, Agent, or Firm*—Jackson & Jones

[57] ABSTRACT

A continuous heat treating furnace for heat treating a ferrous metal work in a protective atmosphere, including a furnace separated into a charge chamber and a heat treating chamber by a partition door and provided with a transport device for transporting the work. A first heating device, a recirculating fan and a gas purge device are provided in the charge chamber, while a second heating device is provided in the heat treating chamber supplied with the protective atmosphere, whereby the work is preheated through convectional heat transfer in the charge chamber simultaneously with high-temperature purging of the charge chamber and then, is heat treated under the protective atmosphere in the heat treating chamber.

8 Claims, 10 Drawing Figures

CONTINUOUS TYPE ATMOSPHERE HEAT TREATING FURNACE

BACKGROUND OF THE INVENTION

The present invention generally relates to continuous type heat treating furnaces such as a continuous type gas carburizing furnace, a continuous type non-oxidizing hardening furnace, a continuous type annealing furnace, etc. and more particularly, to a continuous type gaseous atmosphere heat treating furnace employing a protective atmosphere.

In heat treatment such as carburizing, carbonitriding, non-oxidizing hardening, bright annealing, etc., it has been conventionally so arranged that a protective atmosphere suitable for heat treatment of ferrous metal works, for example, a carburizing gas, an endothermic gas, an exothermic gas, a mixture of the endothermic gas and the exothermic gas, etc. is drawn into the furnace such that the heat treatment is performed under the protective atmosphere. Continuous type atmosphere heat treating furnaces to be used for such heat treatment include a charge vestibule or a discharge vestibule designed for protecting atmosphere in the furnaces. The charge vestibule or the discharge vestibule, which is of a steel structure, is provided with a proper purge means and is substantially maintained at ambient temperatures. Accordingly, the known furnaces have such a drawback that in the case where the charge or discharge vestibule is subjected to gas purging at the time of transfer of the works from the charge vestibule to a heat treating chamber or transfer of the works from the heat treating chamber to the discharge vestibule, a purge gas in an amount four to six times a capacity of the charge or discharge vestibule is required to be used, thereby making the gas purging uneconomical. Furthermore, the known furnaces have such a disadvantage that since the works are heated from ambient temperatures in the heat treating chamber, the heat treating chamber itself is required to be made large in size, thus resulting in poor thermal efficiency of the heat treating chamber.

Meanwhile, in the case of gas carburizing, non-oxidizing hardening, etc. in which a combustible protective atmosphere is introduced into the heat treating chamber during the heat treatment, it has been so arranged that the atmosphere in the heat treating chamber is supplied into the charge or discharge vestibule so as to subject the charge or discharge vestibule to gas purging. In this case, the purge gas (combustible gas) is exhausted from the furnaces and burned off in the environment outside the furnace and thus, is not effectively utilized. Moreover, in gas carburizing, non-oxidizing hardening, etc., the works are washed by using trichloroethylene (trichlene) or are cleaned through heating thereof prior to loading of the works into the furnaces in order to remove from the works impurities such as oil, etc. adhering thereto. A cleaning apparatus for cleaning the works through heating thereof, i.e., for removing impurities such as oil, etc. from the works through heating thereof is proposed in Japanese Patent Publication No. 2588/1983. This prior art cleaning apparatus is separately provided forwardly of a continuous furnace so as to remove impurities such as cutting oil, etc. From the works through heating thereof. Subsequently, after the charge vestibule of the continuous furnace has been subjected to gas purging for about 20 to 30 min., the works are loaded into the heat treating chamber (gas carburizing chamber). Consequently, this prior art continuous furnace has such inconveniences that amount of the consumed purge gas increases, that heat possessed by the works at the time of cleaning of the works through heating thereof is not effectively utilized and that the production cost rises.

SUMMARY OF THE INVENTION

Accordingly, an essential object of the present invention is to provide a continuous type atmosphere heat treating furnace whose production cost is low and in which a purge gas required therefor is not only reduced in amount but effectively utilized, with substantial elimination of the disadvantages inherent in conventional heat treating furances of this kind.

Another important object of the present invention is to provide an atmosphere heat treating furnace of the above described type in which a heating time period is reduced for the purpose of energy saving through utilization of heat of cutting oil, etc. adhering to works to be treated.

In order to accomplish these objects according to one preferred embodiment of the present invention, there is provided a continuous heat treating furnace for heat treating a ferrous metal work in a protective atmosphere, comprising: a furnace which is lined with refractories; a loading door which is provided at one end of said furnace; a discharge door which is provided at the other end of said furnace such that said work is loaded into and discharged out of said furnace through said loading door and said discharge door, respectively; a partition door for separating said furnace into a charge chamber and a heat treating chamber arranged in this order in a processing sequence of said continuous heat treating furnace such that said protective atmosphere is supplied into said heat treating chamber; a transport means for transporting said work from said one end to said other end of said furnace; said partition door and said transport means being provided in said furnace; a first heating means for maintaining a temperature in said charge chamber at a first predetermined value; a recirculating fan for agitating an atmosphere in said charge chamber; a gas purge means for purging said charge chamber at the time of loading of said work into said charge chamber; said first heating means, said recirculating fan and said gas purge means being provided in said charge chamber; and a second heating means for maintaining a temperature in said heat treating chamber at a second predetermined value, which is provided in said heat treating chamber, whereby said work, while said charge chamber is being purged at high temperatures by said gas purge means, is preheated through convectional heat transfer in said charge chamber by said first heating means and said recirculating fan and then, is heat treated under said protective atmosphere in said heat treating chamber.

BRIEF DESCRIPTION OF THE DRAWINGS

These objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
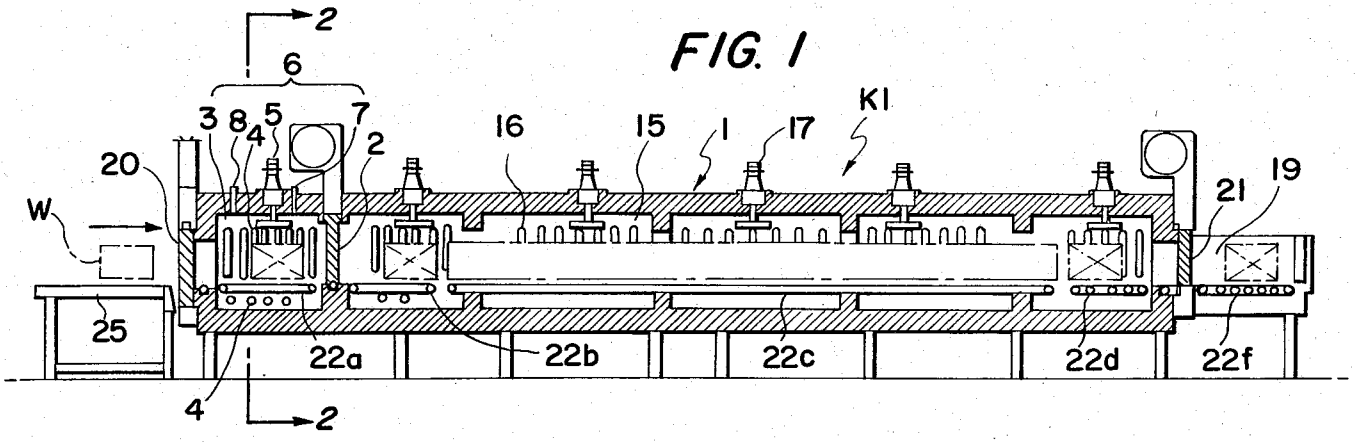
FIG. 1 is a schematic longitudinal sectional view of a continuous type atmosphere heat treating furnace according to a first embodiment of the present invention.
Figure 2:
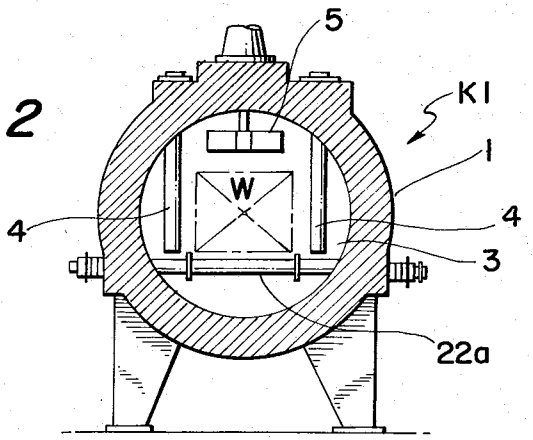
FIG. 2 is an enlarged cross-sectional view taken along the line II—II in FIG. 1.
Figure 3:
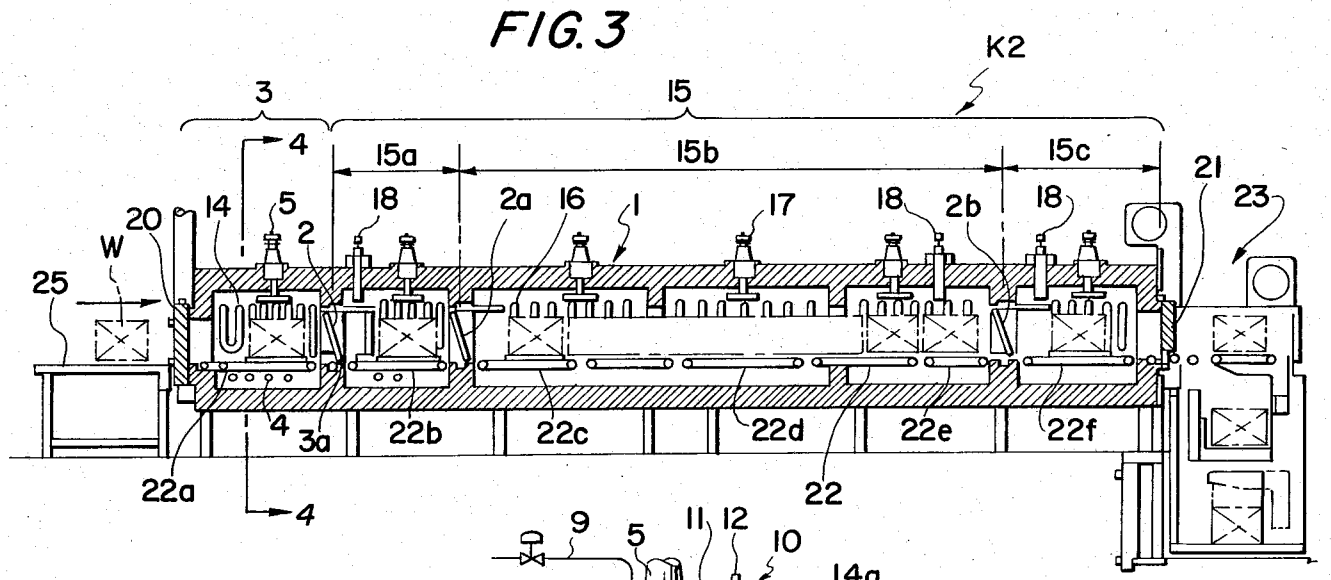
FIG. 3 is a view similar to FIG. 1, particularly showing a second embodiment of the present invention.
Figure 4:
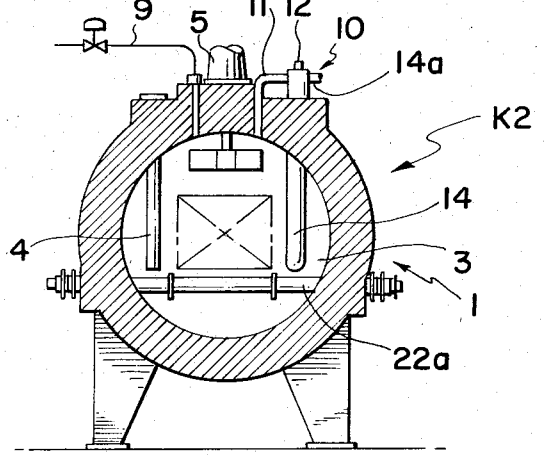
FIG. 4 is an enlarged cross-sectional view taken along the line IV—IV in FIG. 3.

Referring now to the drawings, there is shown in FIGS. 1 and 2, a continuous type gaseous atmosphere heat treating furnace K1 according to a first embodiment of the present invention. The furnace K1 includes a furnace 1. The furnace 1 is separated into a charge chamber 3 and a heat treating chamber (annealing chamber) 15 by a partition door 2. In the charge chamber 3, a heater 4 acting as an indirect heating means is provided. Furthermore, a recirculating fan 5 and a gas purge means 6 are provided at a top wall of the charge chamber 3. The gas purge means 6 is constituted by a supply pipe 7 for introducing $N_2$ gas into the charge chamber 3 and a discharge pipe 8. Meanwhile, a heater 16 is provided in the heat treating chamber 15. A plurality of recirculating fans 17 are provided at a top wall of the heat treating chamber 15.

The furnace K1 further includes a discharge vestibule 19 provided with a gas purge means (not shown). A loading door 20 and a discharge door 21 are, respectively, provided at opposite ends of the furnace 1. The furnace K1 includes conveyor roller units 22*a* to 22*d* and 22*f* which are driven independently of one another for transporting the work W to be treated. Namely, the conveyor roller unit 22*a* is provided in the charge chamber 3, while the conveyor roller units 22*b*, 22*c* and 22*d* are provided in the heat treating chamber 15. Meanwhile, the conveyor roller unit 22*f* is provided in the discharge vestibule 19.

An annealing process of the furnace K1 of the above described arrangement will be described, hereinbelow. Initially, a temperature in the charge chamber 3 is raised to a predetermined value, for example, 500° C. by the heater 4. Then, the work W is loaded from a loading table 25 into the charge chamber 3 upon opening of the loading door 20. The work W is preheated through convection by the recirculating fan 5 while being conveyed at low speed upon low-speed rotation of the conveyor roller unit 22*a*. At the same time, $N_2$ gas is fed into the charge chamber 3 from the supply pipe 7 so as to purge the charge chamber 3. After the work W has been preheated in the charge chamber 3 for a predetermined time period, the work W is transferred from the charge chamber 3 to the heat treating chamber 15 at high speed upon opening of the partition door 2 and synchronous rotations of the conveyor roller units 22*a* and 22*b*. Subsequently, the work W is conveyed towards the discharge vestibule 19 so as to be heated, soaked and cooled under protective atmosphere in the heat treating chamber 15 and finally, is discharged out of the furnace K1 via the discharge vestibule 19.

Figure 5:
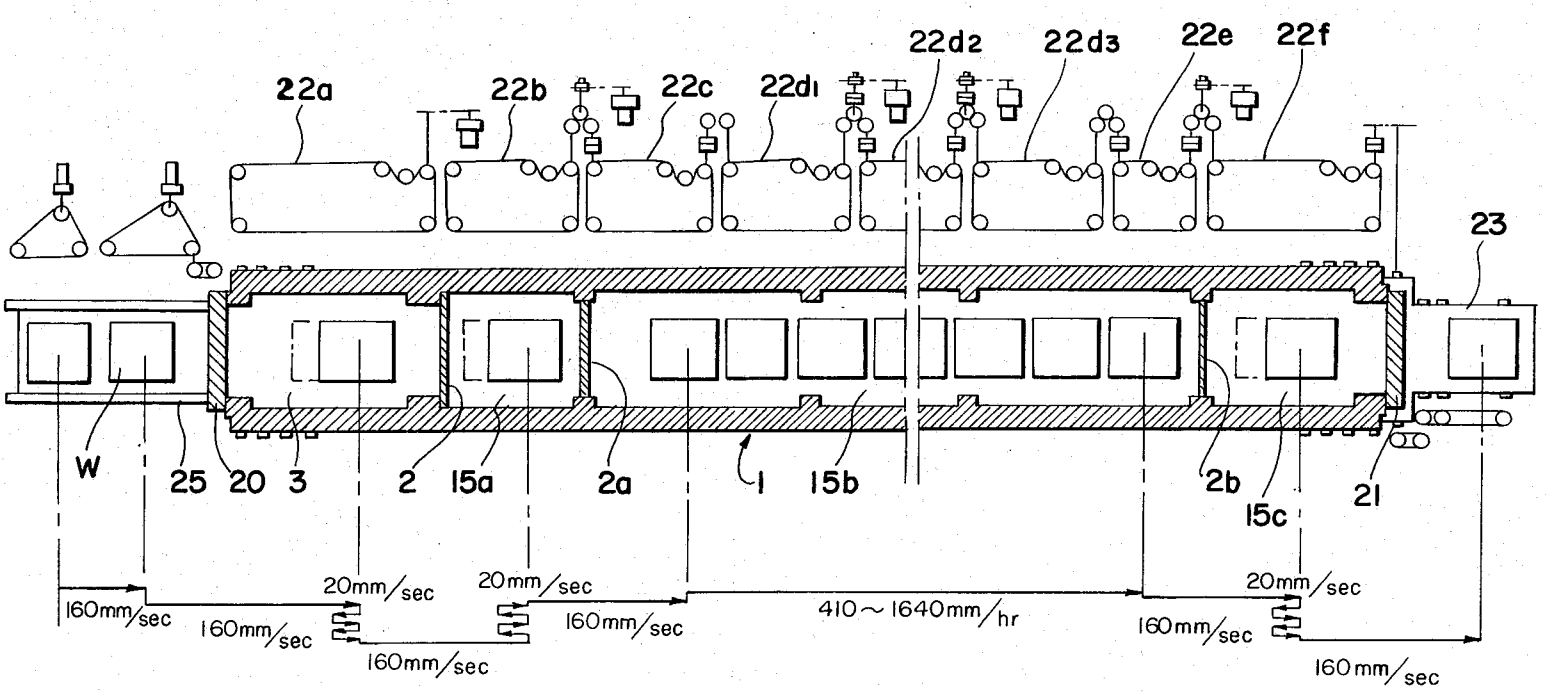
FIG. 5 is a schematic horizontal sectional view of the furnace of FIG. 3, particularly showing a plurality of driving devices for driving a plurality of roller units for conveying articles to be treated and transfer speeds of the articles driven by the driving devices.

Referring now to FIGS. 3 to 7, there is shown a continuous type atmosphere heat treating furnace K2 according to a second embodiment of the present invention. In the same manner as the furnace K1, the furnace K2 includes the furnace 1 which is separated into the charge chamber 3 and the heat treating chamber 15 by the partition door 2. The heat treating chamber 15 is further separated into a heating chamber 15*a*, a carburizing chamber 15*b* and a cooling chamber 15*c* by partition doors 2*a* and 2*b*. The furnace K2 further includes a hardening apparatus 23 following the cooling chamber 15*c*. Meanwhile, the furnace K2 includes the conveyor roller units 22*a*, to 22*f* which are driven independently of one another for transporting the work W. Namely, the conveyor roller units 22*a*, 22*b* and 22*f* are provided in the charge chamber 3, the heating chamber 15*a* and the cooling chamber 15*c*, respectively. The carburizing chamber 15*b* is provided with three conveyor roller units, i.e., an inlet conveyor roller unit 22*c*, a central conveyor roller unit 22*d* and an outlet conveyor roller unit 22*e*. The central roller unit 22*d* is further divided into a plurality of, for example, three roller segments 22*d*1, 22*d*2 and 22*d*3 as shown in FIG. 5. It is to be noted that the conveyor roller units 22*a*, 22*b* and 22*f* provided in the charge chamber 3, the heating chamber 15*a* and the cooling chamber 15*c*, respectively can be rotated not only forwardly but reversely so as to reciprocate the work W in the charge chamber 3, the heating chamber 15*a* and the cooling chamber 15*c*.

Meanwhile, the charge chamber 3 is provided with the heater 4 acting as an indirect heating means, the recirculating fan 5, an air supply pipe 9 for burning off cutting oil, etc. adhering to the work W and a radiant tube 14. The radiant tube 14 is coupled, at one end thereof disposed outwardly of the furnace K2, with a discharge pipe 11 for discharging exhaust gas. The discharge pipe 11 is communicated with the charge chamber 3. the radiant tube 14 is provided, at its portion coupled with the discharge pipe 11, with a pilot burner 12 and an air inflow tube 14*a* for introducing combustion air into the radiant tube 14. A purge gas, (a combustible gas in the heat treating chamber 15), which is drawn into the charge chamber 3 through a gap 3*a* between the partition door 2 and the inner face of the wall of the furnace 1, is exhausted from the furnace K2 by way of the discharge pipe 11 and the radiant tube 14. Namely, the gas purge means 6 is constituted by the gap 3*a* and the radiant tube 14. Meanwhile, a combustion means 10 for burning the combustible gas is constituted by the air supply pipe 9, the air inflow tube 14*a*, the pilot burner 12, the charge chamber 3 and the radiant tube 14, with the charge chamber 3 and the radiant tube 14 acting as combustion chambers for the combustible gas. Furthermore, each of the heating chamber 15*a*, the carburizing chamber 15*b* and the cooling chamber 15*c* constituting the heat treating chamber 15 is provided with the heater 16, the recirculating fan 17 and a gas generator 18 for generating an endothermic gas that acts as a carrier gas.

Figure 7:
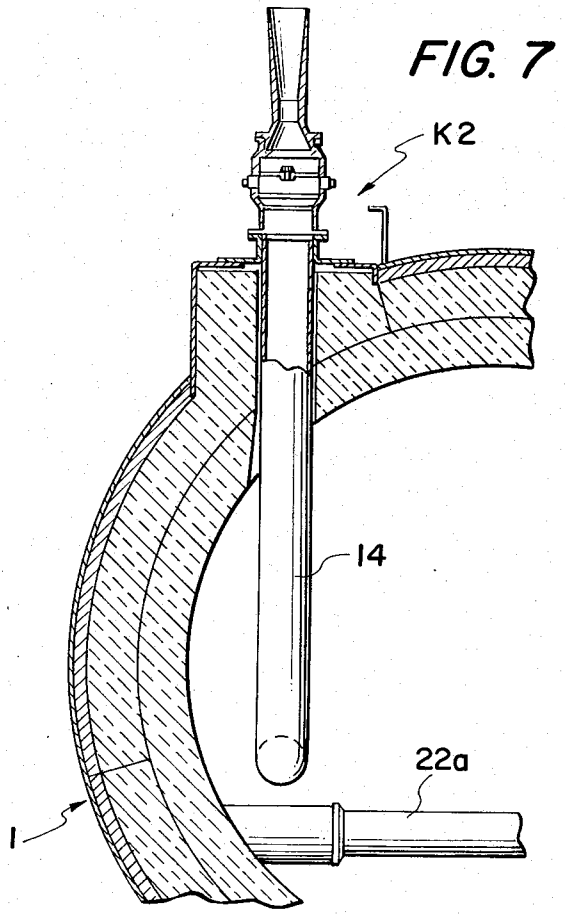
FIGS. 6 and 7 are enlarged fragmentary cross-sectional views of the furnace of FIG. 3.
Figure 6:
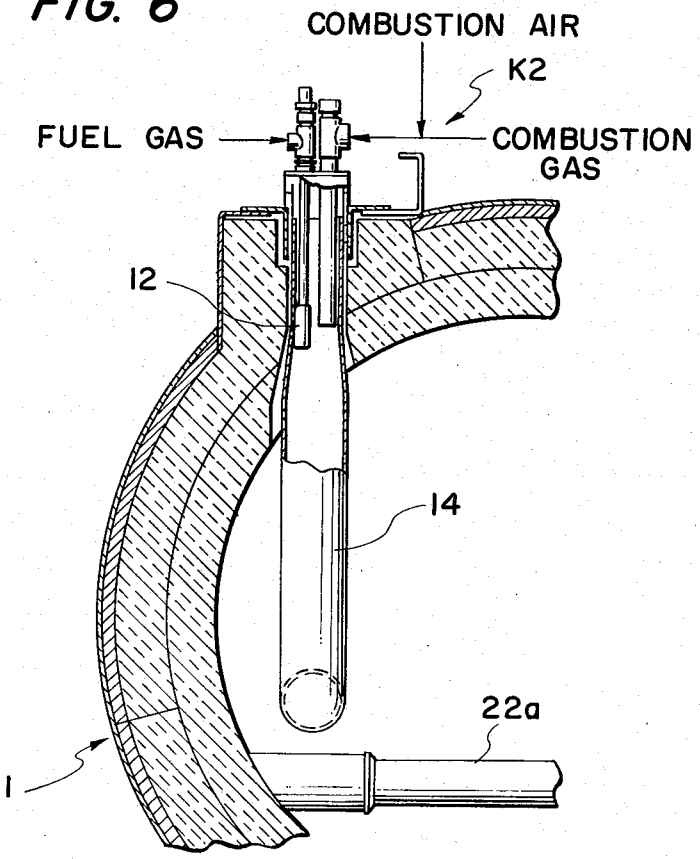

As shown in FIG. 5, the furnace 1 is lined with refractories and the furnace K2 includes a plurality of driving devices for driving the conveyor roller units 22*a* to 22*f*, respectively. Accordingly, the conveyor roller units 22*a* to 22*f* are driven independently of one another by the driving devices so as to transport the work W in the furnace K2 at speeds shown in FIG. 5. FIGS. 6 and 7 show constructions of the radiant tube 14 in detail.

Hereinbelow, a continuous gas carburizing process of the work W having cutting oil, etc. adhering thereto in the above described continuous type gaseous atmosphere heat treating furnace K2 of the roller hearth arrangement will be described. Initially, a temperature in the charge chamber 3 is raised to a predetermined value, for example, about 800° C. by the heater 4. Subsequently, upon opening of the loading door 20, the work W is loaded from the loading table 25 into the charge chamber 3. The work W disposed in the charge chamber 3 is reciprocated in the charge chamber 3 upon forward and reverse rotations of the conveyor roller unit 22*a* and, at the same time, is preheated through convection by the heater 4 and the recirculating fan 5. During this time period, the cutting oil, etc. adhering to the work W are vaporized through heating thereof. In the charge chamber 3, this vaporized oil is subjected to complete combustion together with the combustible gas supplied into the charge chamber 3 by a predetermined amount of air introduced into the charge chamber 3 from the air supply pipe 9. This combustion gas is exhausted out of the furnace K2 by way of the discharge pipe 11 and the radiant tube 14. When the above described operation for vaporizing from the work W through heating thereof the cutting oil or the like adhering thereto has been completed, supply of air into the charge chamber 3 from the air supply pipe 9 is stopped. Thereafter, the charge chamber 3 is purged by using atmosphere (combustible gas) of the heat treating chamber 15 flowing into the charge chamber 3 through the gap 3*a* between the partition door 2 and the inner face of the wall of the furnace 1. Before being exhausted from the furnace K2 by way of the discharge pipe 11 and the radiant tube 14, the purge gas is burnt in the radiant tube 14 upon ignition of the burner 12 connected, outwardly of th furnace 1, with the radiant tube 14 and upon introduction of air into the radiant tube 14 from the air inflow tube 14*a* and the heat of combustion is utilized for heating in the charge chamber 3.

When purging of the charge chamber 3 has been completed, the work W, which has been cleaned through heating thereof and has been preheated in the charge chamber 3, is transferred from the charge chamber 3 to the heating chamber 15*a* upon opening of the partition door 2 and synchronous forward rotations of the conveyor roller units 22*a* and 22*b*. After the work W has been transferred from the charge chamber to the heating chamber 15*a*, the partition door 2 is closed and the work W is heated substantially to a carburizing temperature while being reciprocated upon forward and reverse rotations of the conveyor roller unit 22*b*. In the meantime, the next work W is loaded into the charge chamber 3 such that preheating of the work W (cleaning of the work W through vaporization of the cutting oil or the like) and purging of the charge chamber 3 are preformed in the same manner as described above. After heating of the work W in the heating chamber 15*a*, the work W is transferred from the heating chamber 15*a* to the carburizing chamber 15*b* upon opening of the partition door 2*a* and synchronous forward rotations of the conveyor roller unit 22*b* in the heating chamber 15*a* and the inlet conveyor roller unit 22*c* in the carburizing chamber 15*b*. Subsequently, the work W is sequentially transported towards the outlet conveyor roller unit 22*e* by the central conveyor roller unit 22*d* so as to be subjected to carburizing and diffusing in the carburizing chamber 15*b*. Then, the next work W is transferred from the charge chamber 3 to the heating chamber 15*a* upon closing of the partition door 2*a*, opening of the partition door 2 and synchronous forward rotations of the conveyor roller units 22*a* and 22*b*.

Thereafter, when the preceding work W transferred to the carburizing chamber 15*b* has been displaced away from the inlet conveyor roller unit 22*c*, the next work W in the heating chamber 15*a* is transported upon opening of the partition door 2*a* and synchronous forward rotations of the conveyor roller units 22*b* and 22*c* so as to come close to the preceding work W. Subsequently, in the same manner as described above, the work W is transported through the charge chamber 3, the heating chamber 15*a* and the carburizing chamber 15*b* so as to be subjected to carburizing. When the foremost work W has reached the outlet conveyor roller unit 22*e* of the carburizing chamber 15*b*, the work W is transferred to the cooling chamber 15*c* upon opening of the partition door 2*b* and synchronous forward rotations of the conveyor roller units 22*e* and 22*f*. In the cooling chamber 15*c*, the work W is cooled to a hardening temperature while being reciprocated upon forward and reverse rotations of the conveyor roller unit 22*f*. After the work W has been cooled to the hardening temperature, the work W is transferred from the cooling chamber 15*c* to the hardening apparatus 23 upon opening of the discharge door 21 and forward rotation of the conveyor roller unit 22*f*. After the work W has been subjected to hardening in the hardening apparatus 23, the work W is discharged out of the furnace K2.

Figure 8:
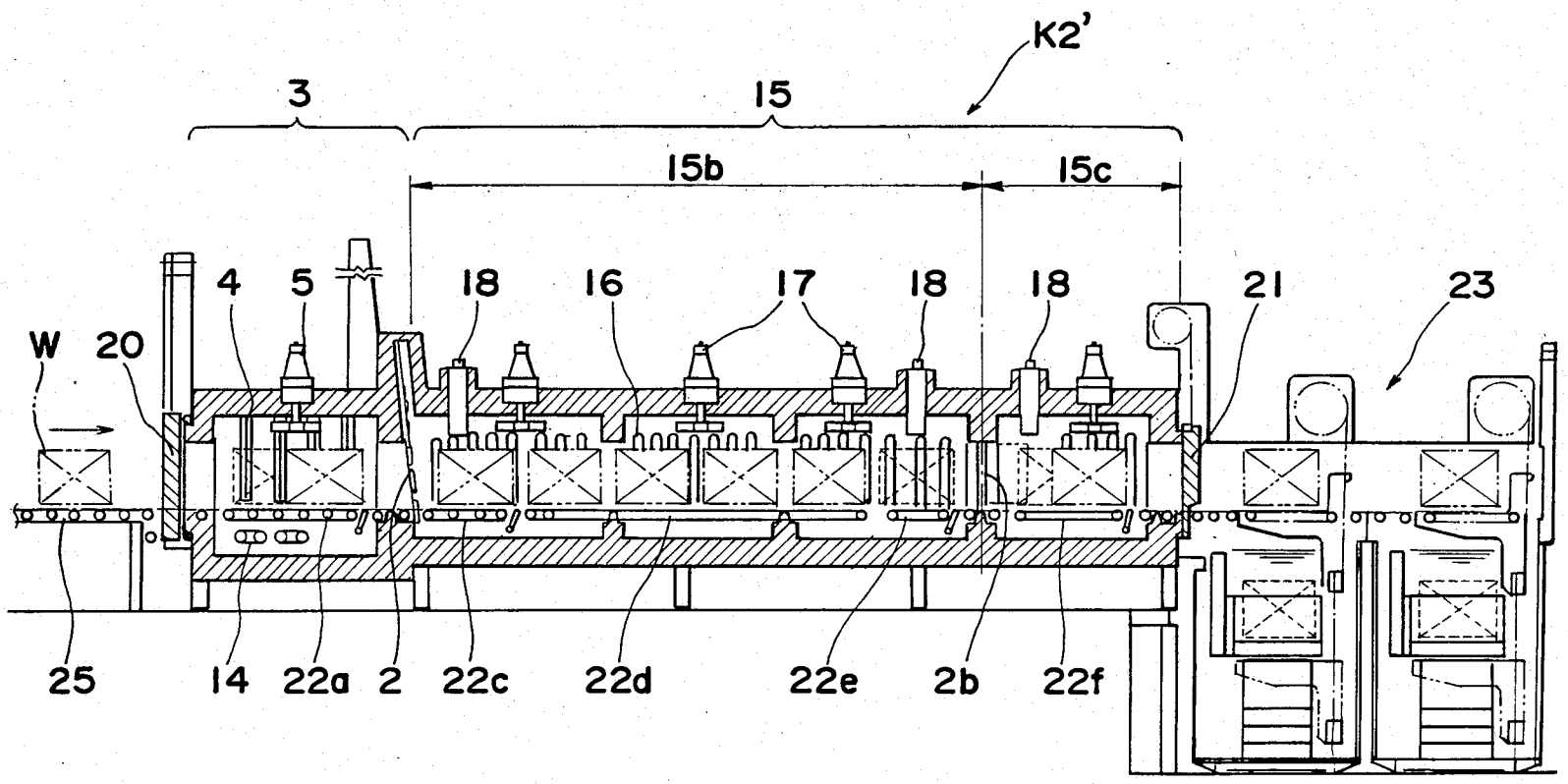
FIG. 8 is a view similar to FIG. 3, particularly showing a first modification thereof.

Referring further to FIG. 8, there is shown a furnace K2′ which is a first modification of the furnace K2. The furnace K2′ includes the partition doors 2 and 2*b* but is not provided with the partition door 2*a*. Thus, the heat treating chamber 15 of the furnace K2′ is separated into the carburizing chamber 15*b* and the cooling chamber 15*c* by the partition doors 2 and 2*b*. In the carburizing chamber 15*b*, the work W is heated to the carburizing temperature and is subjected to carburizing and diffusing while being maintained at the carburizing temperature. Then, the work W is maintained at the hardening temperature in the cooling chamber 15*c*. Since other constructions of the furnace K2′ are substantially similar to those of the furnace K2, detailed description thereof is abbreviated for the sake of brevity. It can be, needless to say, also so arranged as shown in FIG. 5 that the central conveyor roller unit 22*d* of the carburizing chamber 15*b* is further divided into a plurality of roller segments.

Figure 9:
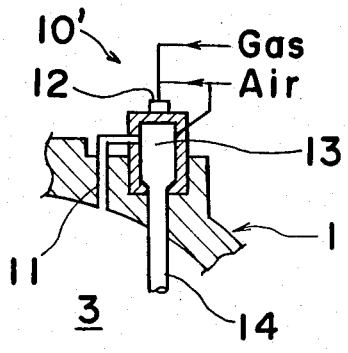
FIG. 9 is a fragmentary view similar to FIG. 4, particularly showing a combustion means which is a modification of that of the furnaces of FIGS. 3 and 4.

FIG. 9 shows a combustion means 10′ which is a modification of the combustion means 10 for burning the combustible gas in the charge chamber 3 of the furnaces K2 and K2′. The combustion means 10′ for burning the combustible gas includes a combustion chamber 13 formed at one end portion of the radiant tube 14, which one end portion projects out of the furnace 1. Consequently, the vaporized cutting oil and the combustible gas which is produced at the time of purging of the charge chamber 3 and operation of the furnace K2 are subjected to complete combustion in the combustion chamber 13 by the pilot burner 12 and through introduction of combustion air into the combustion chamber 13 and then, are exhausted out of the furnace K2 via the radiant tube 14.

Figure 10:
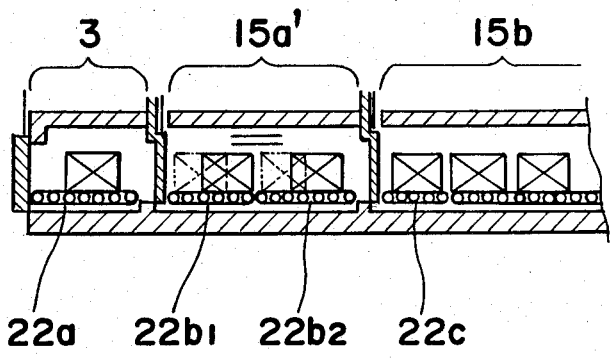
FIG. 10 is a fragmentary view similar to FIG. 3, particularly showing a heating chamber which is a modification of that of the furnace of FIG. 3.

Meanwhile, FIG. 10 is a heating chamber 15*a'* which is a modification of the heating chamber 15*a* of the furnace K2. In the heating chamber 15*a'*, the conveyor roller unit 22*b* of the heating chamber 15*a* of the furnace K2 is divided into a plurality of, for example, two segments, i.e., conveyor roller units 22*b*1 and 22*b*2 driven independently of each other such that a plurality of, i.e., two works W in this case, are accommodated in the heating chamber 15*a'*.

It is to be noted that the roller hearth type transport means is employed for transporting the work W in the above described embodiments of the present invention but can be replaced by any other transport means of tray pusher type, etc.

As is clear from the foregoing description, in the present invention, the charge chamber provided with the heating means and the recirculating fan is employed in place of the prior art charge vestibule by separating the work loading side of the furnace by the use of the retractable partition door.

Accordingly, in accordance with the present invention, since the work can be preheated through convection in the charge chamber simultaneously with purging of the charge chamber, the work can be preheated uniformly and rapidly, thereby resulting in reduction of the heating time period of the work.

Furthermore, in accordance with the present invention, since the charge chamber is purged at high temperatures, amount of the purge gas consumed therefor can be reduced drastically. For example, it was found that when the charge chamber is set at a temperature of 800° C., a necessary amount of the purge gas is reduced to about 29% of that of the prior art charge vestibule held at ambient temperatures.

Moreover, in accordance with the present invention, since the combustion means for burning the combustible gas is provided in the charge chamber, the work can be cleaned through heating thereof in the charge chamber in the case where a combustible protective atmosphere for a gas carburizing process, a non-oxidizing heating process, etc. is used in the continuous type gaseous atmosphere heat treating furnace. Thus, heat possessed by the work at the time of cleaning of the work through heating thereof can be effectively used. Furthermore, heat of combustion of the combustible gas at the time of cleaning of the work through heating thereof and the combustible gas in the heat treating chamber can be used as a part of the heat source of the charge chamber. Consequently, the heating time period of the work in the heating chamber can be reduced due to the effect of preheating of the work, thereby resulting in saving of energy.

Meanwhile, in the present invention, it can be so arranged that the transport means of the continuous type atmosphere heat treating furnace is of roller hearth type and the furnace is a continuous type gas carburizing furnace, namely, the furnace is separated into the charge chamber, the heating chamber, the carburizing chamber and the cooling chamber or into the charge chamber, the carburizing chamber and the cooling chamber by the partition doors and the conveyor roller units driven independently of one another are, respectively, provided in the chambers such that the work is reciprocated during the heating process for heating the work of the carburizing temperature and the cooling process for cooling the work to the hardening temperature. Thus, in accordance with the present invention, the work is uniformly heated so as to prevent nonuniform carburizing of the work and is uniformly cooled with consequent elimination of nonuniform hardening of the work. Furthermore, since heating of the work to the carburizing temperature and cooling of the work to the hardening temperature can be performed rapidly, it becomes possible to reduce the length of the furnace.

In addition, in accordance with the present invention, since the central conveyor roller unit of the carburizing chamber is constituted by a plurality of the roller segments, vacant regions in the carburizing chamber can be reduced at the time of change of the carburizing conditions and thus, the carburizing conditions can be changed efficiently.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A continuous heat treating furnace for heat treating a ferrous metal work in a combustible protective atmosphere, said furnace being lined with refractories and comprising:

a charge door which is provided at one end of said furnace;

a discharge door which is provided at the other end of said furnace;

a partition door for separating said furnace into a charge chamber and a heat treating chamber;

a heating means for heating said work in said charge chamber and said heat treating chamber;

a transport means for transporting said work in said charge chamber and said heat treating chamber;

a recirculating fan for transferring convectional heat to said work;

a gas purge means for purging said charge chamber;

a combustion means for burning, into burnt exhaust gas, combustible exhaust gas generated by burning an atmosphere in said charge chamber so as to supply the potential heat of the burnt exhaust gas, as radiant heat, to said charge chamber;

said recirculating fan, said purge means and said combustion means being provided in said charge chamber; and an agitating means for agitating the combustible protective atmosphere supplied into said heat treating chamber, which is provided in said heat treating chamber, whereby said work is preheated in said charge chamber to a temperature enabling sufficient vaporization of such impurities as oil on said work and then, is subjected to a predetermined heat treatment in said heat treating chamber.

2. A continuous heat treating furnace as claimed in claim 1, wherein said gas purge means is constituted by a gap defined between a peripheral face of said partition door and an inner face of a wall of said furnace, a radiant tube and a discharge pipe;

said radiant tube being provided, at its one end extending out of said furnace, with a pilot burner;

said discharge pipe having one end communicating with an inside of said charge chamber and the other end connected with said pilot burner of said radiant tube, whereby a purge gas is drawn into said charge chamber through said gap and is released out of said furnace through said discharge pipe and said radiant tube, 3. A continuous heat treating furnace for gas carburizing a ferrous metal work, said furnace being lined with refractories and comprising;

a charge door which is provided at one end of said furnace;

a discharge door which is provided at the other end of said furnace;

a first partition door for separating said furnace into a charge chamber and a heat treating chamber;

a second partition door for separating said heat treating chamber into a carburizing chamber and a cooling chamber;

a heating means for heating said work in said charge chamber, said carburizing chamber and said cooling chamber;

a transport means for transporting said work in said charge chamber, said carburizing chamber and said cooling chamber;

a recirculating fan for transferring convectional heat to said work;

a gas purge means for purging said charge chamber; and a combustion means for burning, into burnt exhaust gas, combustible exhaust gas generated by burning an atmosphere in said charge chamber so as to supply potential heat of the burnt exhaust gas, as radiant heat, to said charge chamber;

said recirculating fan, said gas purge means and said combustion means being provided in said charge chamber, whereby after said work has been preheated in said charge chamber to a temperature enabling sufficient vaporization of such impurities as oil on said work, said work is subjected to carburizing and diffusing proceses in said carburizing chamber upon heating of said work to a carburizing temperature and then, is cooled to a hardening temperature in said cooling chamber.

4. A continuous heat treating furnace as claimed in claim 3, wherein said combustion means is constituted by an air supply pipe communicating with an inside of said charge chamber, a radiant tube, a discharge pipe and an air supply means for burning the combustible exhaust gas of said charge chamber;

said radiant tube being provided, at its one end extending out of said furnace, with a pilot burner;

said discharge pipe having one end communicating with the inside of said charge chamber and the other end opening in the vicinity of said pilot burner of said radiant tube, whereby the combustible exhaust gas of said charge chamber is burnt in said radiant tube and the burned exhaust gas is released out of said furnace through said radiant tube.

5. A continuous heat treating furnace as claimed in claim 3, wherein said combustion means is constituted by a radiant tube provided, at its one end extending out of said furnace, with a combustion chamber, a discharge pipe, a pilot burner provided in said combustion chamber and an air supply means for supplying air into said combustion chamber for burning the combustible exhaust gas;

said discharge pipe having one end communicating with an inside of said charge chamber and the other end communicating with said combustion chamber, whereby the combustible exchaust gas is burnt in said combustion chamber and the burnt exhaust gas is released out of said furnace through said radiant tube.

6. A continuous heat treating furnace as claimed in claim 3, further comprising:

a third partition door for separating said carburizing chamber into a heating chamber and a carburizing and diffusing chamber, whereby said work is heated to the carburizing temperature in said heating chamber and then, is subjected to the carburizing and diffusing proceses in said carburizing and diffusing chamber.

7. A continuous heat treating furnace as claimed in claim 6, wherein said transport means is constituted by a first roller unit for said charge chamber, a second roller unit for said heating chamber, a third roller unit for said carburizing and diffusing chamber and, a fourth roller unit for said cooling chamber which are driven independly of one another;

said second and fourth roller units being rotated forwardly and reversely so as to reciprocate said work in said heating chamber at the time of heating of said work to the carburizing temperature and in said cooling chamber at the time of cooling of said work to the hardening temperature.

8. A continuous heat treating furnace as claimed in claim 3, wherein said transport means is constituted by a first roller unit for said charge chamber, a second roller unit for said carburizing chamber and a third roller unit for said cooling chamber which are driven independently of one another;

said first and third roller units being rotated forwardly and reversely so as to reciprocate said work in said charge chamber at the time of purging of said charge chamber and in said cooling chambers the time of cooling of said work to the hardening temperature.

* * * * *